US009022410B2

(12) United States Patent
Giordani

(10) Patent No.: US 9,022,410 B2
(45) Date of Patent: May 5, 2015

(54) SKI BINDING DEVICE FOR FASTENING A MOUNTAINEERING BOOT ON A DOWNHILL SKI

(75) Inventor: Roberto Giordani, Rovereto (IT)

(73) Assignee: Tasci S.R.L. (IT)

( * ) Notice: Subject to any disclaimer, the term of this patent is extended or adjusted under 35 U.S.C. 154(b) by 0 days.

(21) Appl. No.: 14/117,112

(22) PCT Filed: May 14, 2012

(86) PCT No.: PCT/IB2012/052405

§ 371 (c)(1), (2), (4) Date: Mar. 31, 2014

(87) PCT Pub. No.: WO2012/156901

PCT Pub. Date: Nov. 22, 2012

(65) Prior Publication Data

US 2014/0291966 A1 Oct. 2, 2014

(30) Foreign Application Priority Data

May 13, 2011 (IT) ..... TV2011A0063

(51) Int. Cl.
*A63C 9/084* (2012.01)
*A63C 9/00* (2012.01)
(Continued)

(52) U.S. Cl.
CPC ..... *A63C 9/0845* (2013.01); *A63C 9/006* (2013.01); *A63C 9/0807* (2013.01); *A63C 9/08528* (2013.01); *A63C 9/086* (2013.01)

(58) Field of Classification Search
CPC ..... A63C 9/003; A63C 9/086; A63C 9/18; A63C 9/0807; A63C 9/0845; A63C 9/082; A63C 9/0847; A63C 9/006
USPC ..... 280/611, 613, 614, 617, 623, 626, 628, 280/629, 632, 633
See application file for complete search history.

(56) References Cited

U.S. PATENT DOCUMENTS 3,561,781 A * 2/1971 Hashioka et al. ..... 280/629
4,261,595 A * 4/1981 Smialowski et al. ..... 280/614
(Continued)

FOREIGN PATENT DOCUMENTS

EP 0519243 12/1992
EP 1559455 8/2005
(Continued)

OTHER PUBLICATIONS

International Search Report and Written Opinion, International Application No. PCT/IB2012/052405 (Oct. 10, 2012).
(Continued)

*Primary Examiner* — John Walters
*Assistant Examiner* — Brian Swenson
(74) *Attorney, Agent, or Firm* — Thompson Hine LLP

(57) ABSTRACT

A ski binding device for fastening a boot on a ski is described. The device includes a toepiece and a heelpiece fixed to the ski and structured to selectively retain the boot. The heelpiece includes a turret and a hooking projecting appendix ("HPA") that juts out from the turret towards the toepiece while remaining substantially parallel to a first reference axis. The turret having a lower casing which is fixed on a fastening base of the toepiece and a titlable upper casing resting hingedly connected thereto to the lower casing. The HPA protrudes from the titlable upper casing while remaining substantially parallel to the first reference axis, and the heelpiece includes a programmed-release locking means structured to lock and retain the upper casing until the titling torque transmitted to the upper casing exceeds a predetermined threshold value.

13 Claims, 6 Drawing Sheets

(51) Int. Cl.

| | |
|---|---|
| ***A63C 9/08*** | (2012.01) |
| ***A63C 9/085*** | (2012.01) |
| ***A63C 9/086*** | (2012.01) |

(56) References Cited

U.S. PATENT DOCUMENTS

| | | | | |
|---|---|---|---|---|
| 4,319,767 | A * | 3/1982 | Emilson | 280/614 |
| 4,512,594 | A * | 4/1985 | Eyre | 280/614 |
| 7,100,938 | B2 * | 9/2006 | Krumbeck et al. | 280/611 |
| 7,438,307 | B2 * | 10/2008 | Damiani et al. | 280/611 |
| 8,388,013 | B2 * | 3/2013 | Indulti | 280/623 |
| 8,439,389 | B2 * | 5/2013 | Moore et al. | 280/617 |
| 8,746,728 | B2 * | 6/2014 | Shute et al. | 280/614 |

FOREIGN PATENT DOCUMENTS

| | | |
|---|---|---|
| EP | 1997397 | 12/2008 |
| WO | 2009/105866 | 9/2009 |

OTHER PUBLICATIONS

Search Report and Opinion, Italian Application No. TV2011A000063 (Dec. 23, 2011).

* cited by examiner

SKI BINDING DEVICE FOR FASTENING A MOUNTAINEERING BOOT ON A DOWNHILL SKI

TECHNICAL FIELD

The present invention relates to a ski binding device for fastening a ski mountaineering boot on a downhill ski or the like.

BACKGROUND ART

As known, the most common ski mountaineering boots substantially consist of a shell made of rigid plastic material which is shaped so as to accommodate the user's foot, and is provided on the bottom with a front sole and a rear heel, usually provided with a lugged profile and made of a non-slip elastomeric material; with a cuff made of a rigid plastic material, which is C-shaped so as to envelop the user's ankle from behind, and is hinged to the upper part of the shell so as to oscillate about a transversal reference axis substantially coinciding with the articulation axis of the ankle; with an inner shoe made of soft, heat-insulating material, which is removably inserted into the shell and the cuff, and is shaped so as to envelop and protect both the foot and the lower part of the user's leg; and with a series of manually-operated closing hooks, which are appropriately distributed on the shell and on the cuff, and are structured so as to tighten the shell and the cuff in order to immobilize the user's leg inside the shoe.

The shell of ski mountaineering boots is usually provided on the front with a small, substantially duck-billed projecting appendix, which protrudes from the nose-shaped tip of the shell remaining locally substantially coplanar with the front sole, and is structured so as to be coupled in rigid, stable, although easily releasable manner, with the toepiece of the ski mountaineering binding device which, in turn, is rigidly fixed onto the central part of the downhill ski.

The ski mountaineering binding device instead consists of a toepiece and a heelpiece, which are rigidly and stably fixed to the back of the downhill ski, at a predetermined distance from each other, and are structured so as to alternatively and as desired:

- lock the shell of the ski boot onto the back of the ski, thus preventing any relative movement between the two elements; or
- lock the shell of the ski boot onto the back of the ski thus allowing the boot to freely oscillate/pivot with respect to the ski about a transversal rotation axis arranged horizontally and roughly positioned at the duck-billed appendix of the shell.

Obviously, the rotation axis of the ski boot is perpendicular to the rotation axis of the downhill ski, i.e. is oriented so as to be locally substantially perpendicular both to the middle plane of the ski and to the middle plane of the ski boot.

In particular, the toepiece is usually provided with a gripper-like clamping member, which is structured so as to clamp and stably retain the projecting duck-billed appendix of the shell, while allowing the shell to freely oscillate/pivot with respect to the ski underneath about the rotation axis of the boot.

The heelpiece of the binding device, instead, is structured so as to selectively hook and lock the rear part of the shell, so as to selectively prevent the boot from rotating by pivoting on the toepiece and moving the heel away from the back of the ski.

More in detail, the heelpiece is usually provided with a pair of projecting pins which jut out from the turret towards the toepiece, next to each other, from opposite sides of the middle plane of the turret, while remaining locally substantially parallel to a reference axis which is locally substantially parallel to the longitudinal axis of the ski. The ends of the two projecting pins are structured so as to engage the rear part of the shell, roughly at the heel, so as to stably hold the heel of the ski boot in abutment on, or however close to, the back of the ski, thus preventing the ski boot from rotating on the toepiece.

In order to allow the automatic unlocking of the binding device if the skier falls, the two projecting pins are structured so as to be elastically spread, in the presence of particularly strong pulse-like mechanical stresses, elastically by a few degrees with respect to each other, while always remaining on a horizontal laying plane locally perpendicular to the middle plane of the turret.

Unfortunately, the above-described automatic unlocking system is not very sensitive to pulse-like mechanical stresses with an inclination angle larger than 10-15° with respect to the vertical.

DISCLOSURE OF INVENTION

It is the object of the present invention to provide a ski mountaineering binding device in which the heelpiece is capable of timely, automatically releasing the rear part of the ski boot even in the presence of pulse-like mechanical stresses strongly inclined with respect to the vertical, thus making the ski mountaineering binding device simpler and more immediate to be use.

In accordance with these objectives, according to the present invention, a binding device is made for fastening a ski mountaineering boot to a downhill ski or the like, as set forth in claim 1 and preferably, but not necessarily, in any one of the dependent claims.

BRIEF DESCRIPTION OF THE DRAWINGS

The present invention will now be described with reference to the accompanying drawings, which show a non-limitative embodiment thereof, in which:

FIG. 8 is a side view of the heelpiece of the ski mountaineering binding device shown in FIG. 1, taken along the vertical middle plane ad in a third operating configuration; whereas

BEST MODE FOR CARRYING OUT THE INVENTION

Figure 1:
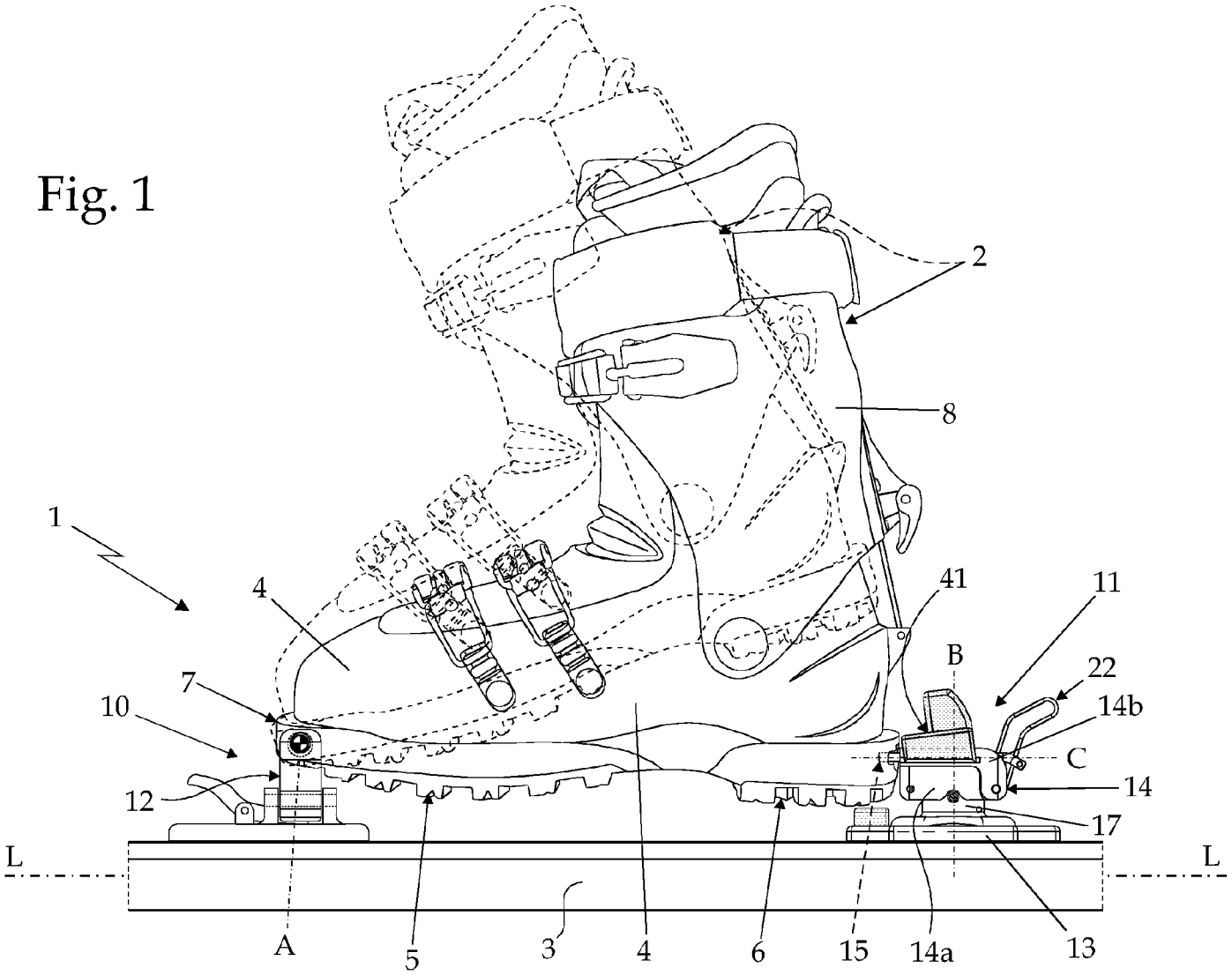
FIG. 1 is a side view of the central segment of a downhill ski which carries a ski mountaineering boot fixed to its back by means of a ski mountaineering binding device made according to the dictates of the present invention.

With reference to FIG. 1, numeral 1 indicates as a whole a ski mountaineering binding device specifically structured to fasten a ski mountaineering or Telemark ski boot 2 onto the central segment of a downhill ski 3, ski mountaineering ski or the like, of the known type, in a stable, although easily releasable manner.

More in detail, the binding device 1 is structured to fasten a ski mountaineering or Telemark ski boot 2 of known type onto the central segment of a downhill ski 3 or the like, which ski boot is provided with a rigid lower shell 4 made of plastic and/or composite material, which is shaped so as to accommodate the user's foot, and is further provided on the bottom with a front sole 5 and a rear heel 6, which preferably, but not necessarily have a lugged profile and are preferably, but not necessarily, made of a non-slip elastomeric material.

Furthermore, the shell 4 is also provided in the front with a small, substantially duck-billed appendix 7, which protrudes from the nose-shaped tip of the shell 4 while remaining locally substantially coplanar to the front sole 5, and is structured so as to be coupled/hooked to the binding device 1 which, in turn, is rigidly fixed to the central segment of the downhill ski 3.

With particular reference to FIG. 1, in the example shown, the ski boot 2, in addition to the shell 4, also comprises a rigid cuff 8 made of a plastic and/or composite material, which is substantially C-shaped so as to envelop the user's ankle from behind, and is hinged onto the upper part of the shell 4 so as to freely oscillate about a transversal reference axis, which is substantially perpendicular to the middle plane of the ski boot (i.e. perpendicular to the sheet plane in FIG. 1), and also substantially and locally coincides with the articulation axis of the user's ankle; an inner shoe made of a soft, heat-insulating material, which is removably inserted into shell 4 and cuff 8, and is shaped so as to envelop and protect both the foot and the lower part of the user's leg; and a series of manually-operated closing hooks, which are positioned on the shell 4 and on the cuff 8, and are structured so as to tighten the shell 4 and the cuff 8 so as to immobilize the user's leg in the shoe 8.

Additionally, shell 4 is finally, preferably but not necessarily, provided with a transversal stiffening bar (not shown) made of a metal material, which extends into the projecting duck-billed appendix 7 while remaining locally substantially perpendicular to the middle plane of the ski boot, and has its two axial ends which emerge/surface from the outside of the projecting appendix 7 at the two side edges of the same appendix.

With reference to FIG. 1, the ski mountaineering binding device 1 instead consists of a toepiece 10 and a heelpiece 11 which are rigidly fixed onto the back of the central segment of the downhill ski 3, aligned along the longitudinal axis L of ski 3, at a predetermined distance from each other, and are structured so as to selectively clamp/hook and retain the front part and the rear part of shell 4, respectively.

More in detail, the toepiece 10 and the heelpiece 11 of the ski mountaineering binding device 1 are structured so as to selectively and as desired:

- stably clamp and retain the front part and the rear part of shell 4 on the central segment of ski 3, thus maintaining the shell 4 immobile on the ski 3 with the sole 5 substantially parallel to the back of the downhill ski 3; or
- stably clamp and retain only the front part of shell 4 on the central segment of ski 3, while allowing the ski boot 2 to freely oscillate/pivot on the back of the ski 3 about a substantially horizontal rotation axis A, which is positioned immediately over the ski 3, at or however close to the tip of shell 4, and is substantially and locally perpendicular to the longitudinal axis L of ski 3 and to the middle plane of the ski boot 2.

In other words, toepiece 10 is provided with a gripper-like clamping member 12 or the like which is structured so as to selectively clamp and retain only the front part of the shell 4, while allowing the front part of the shell 4 to freely oscillate/pivot on the toepiece 10 about the rotation axis A of the ski boot.

Heelpiece 11 is instead structured so as to selectively hook and lock/retain the rear part of the shell 4 roughly at the heel, so as to stably retain the heel 6 of the ski boot 2 in abutment on, or however close to, the back of the ski 3, and therefore prevent any rotation of the ski boot 2 on the toepiece 10 about the rotation axis A of the ski boot.

With reference to FIG. 1, in the example shown, the clamping member 12 of the toepiece 10 is structured so as to tighten the side edges of the projecting appendix 7 of the shell, thus being in abutment on the projecting appendix 7 at the two axial ends of the transversal stiffening bar possibly embedded in the appendix itself, while allowing the projecting appendix 7 of the shell to freely oscillate/pivot with respect to the toepiece 10 at the contact points between the gripper-like clamping member 12 and the side edges of the projecting appendix 7.

In other words, the rotation axis A of the ski boot is positioned on the projecting appendix 7 of shell 4, at the contact points between the gripper-like clamping member 12 and the side edges of the projecting appendix 7. Furthermore, when the front part of shell 4 is fixed onto the toepiece 10 by means of the clamping member 12, the longitudinal axis of the transversal stiffening bar of the projecting appendix 7, if present, coincides with the rotation axis of the ski boot 2.

The toepiece 10 of the ski mountaineering binding device 1 is a component widely known in the field and will not be further described.

Figure 2:
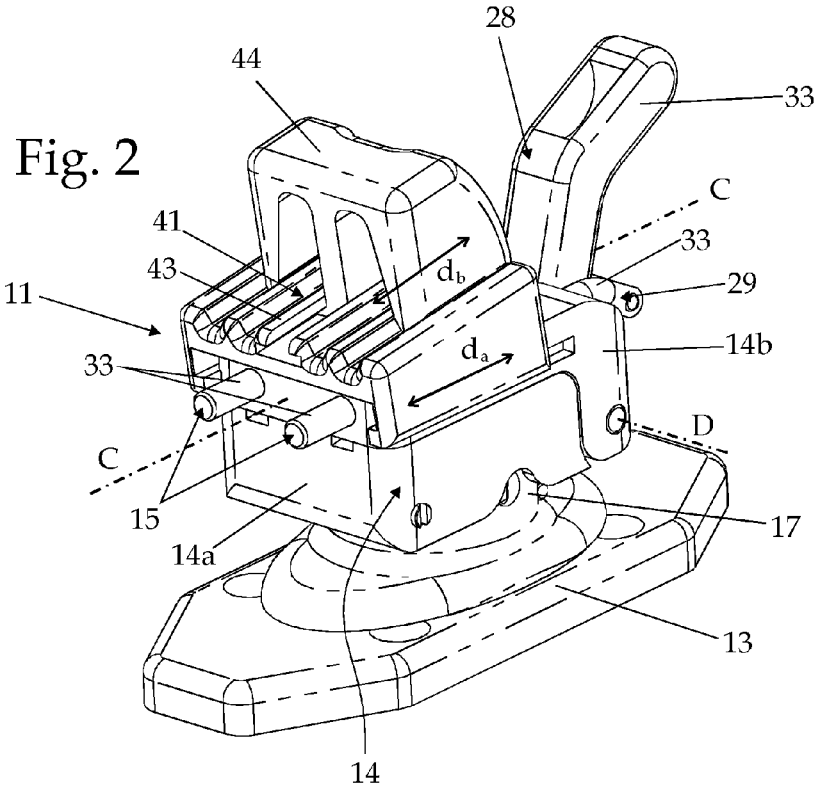
FIGS. 2 and 3 are two axonometric views of the heelpiece of the ski mountaineering binding device shown in FIG. 1.
Figure 3:
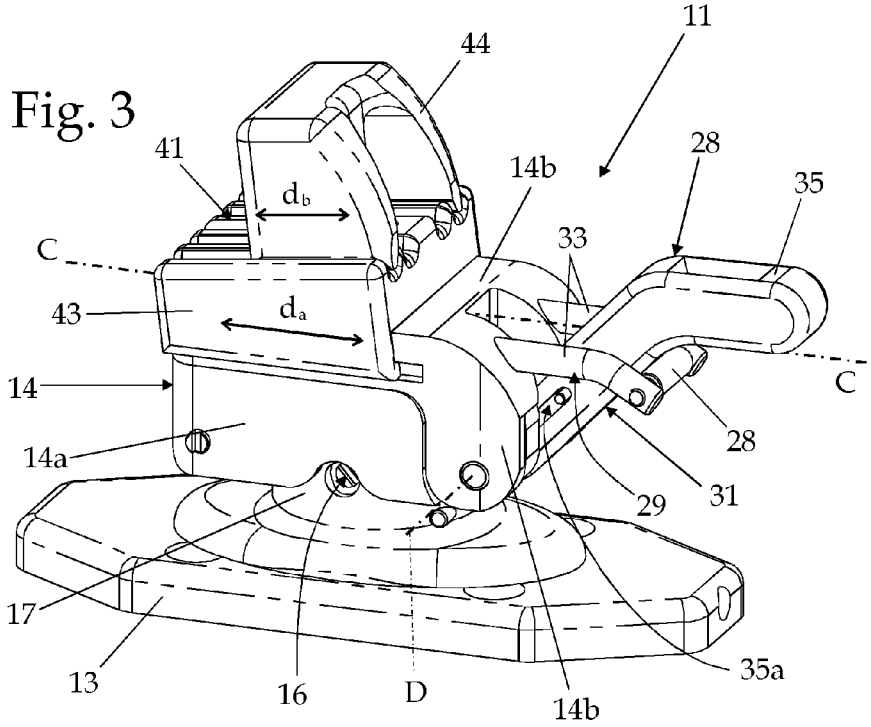

With reference to FIGS. 1, 2 and 3, the heelpiece 11 of the ski mountaineering binding device 1 comprises instead a fastening plate or base 13 which is structured so as to be rigidly fastened to the back of the downhill ski 3 or the like; and a turret 14 which protrudes upwards from the upper face of the fastening plate 13, parallel to a reference axis B which is preferably, but not necessarily, locally substantially perpendicular to the laying plane of the fastening plate 13, i.e. is locally substantially perpendicular to the back of the ski 3 itself and to the longitudinal ski axis L.

Furthermore, heelpiece 11 comprises a hooking projecting appendix 15 which juts out from the turret 14 towards the toepiece 10, and is structured so as to hook/couple to the rear part of the shell 4 roughly at the heel, so as to stably retain the heel 6 of the ski boot 2 in abutment on, or however close to, the back of the ski 3, thus preventing any rotation of the ski boot 2 on the toepiece 10 about the rotation axis A of the boot.

More in detail, the hooking projecting appendix 15 juts out from the turret 14 remaining locally substantially parallel to a reference axis C which is preferably arranged locally substantially parallel to, or however aligned with, the longitudinal axis L of ski 3, and is shaped/structured so as to reach and engage the rear part of the shell 4 to stably retain the heel 6 of the ski boot 2 in abutment on, or however close to, the back of ski 3, when axis C is parallel to, or however substantially aligned with, the longitudinal ski axis L.

Furthermore, the heelpiece 11 is positioned on the central segment of the downhill ski 3 or the like at a predetermined nominal distance from the clamping member 12 of the toepiece 10, so as to allow the projecting appendix 15 to reach and stably hook/lock the rear part of the shell 4, when the clamping member 12 of the toepiece 10 is tightened/closed on the projecting appendix 7 of shell 4 and allows the ski boot 2 to rotate on the toepiece 10 about axis A.

The value of the distance between toepiece 10 and heelpiece 11 obviously depends on the dimensions/length of the shell 4, i.e. on the size of the ski boot 2.

Figure 4:
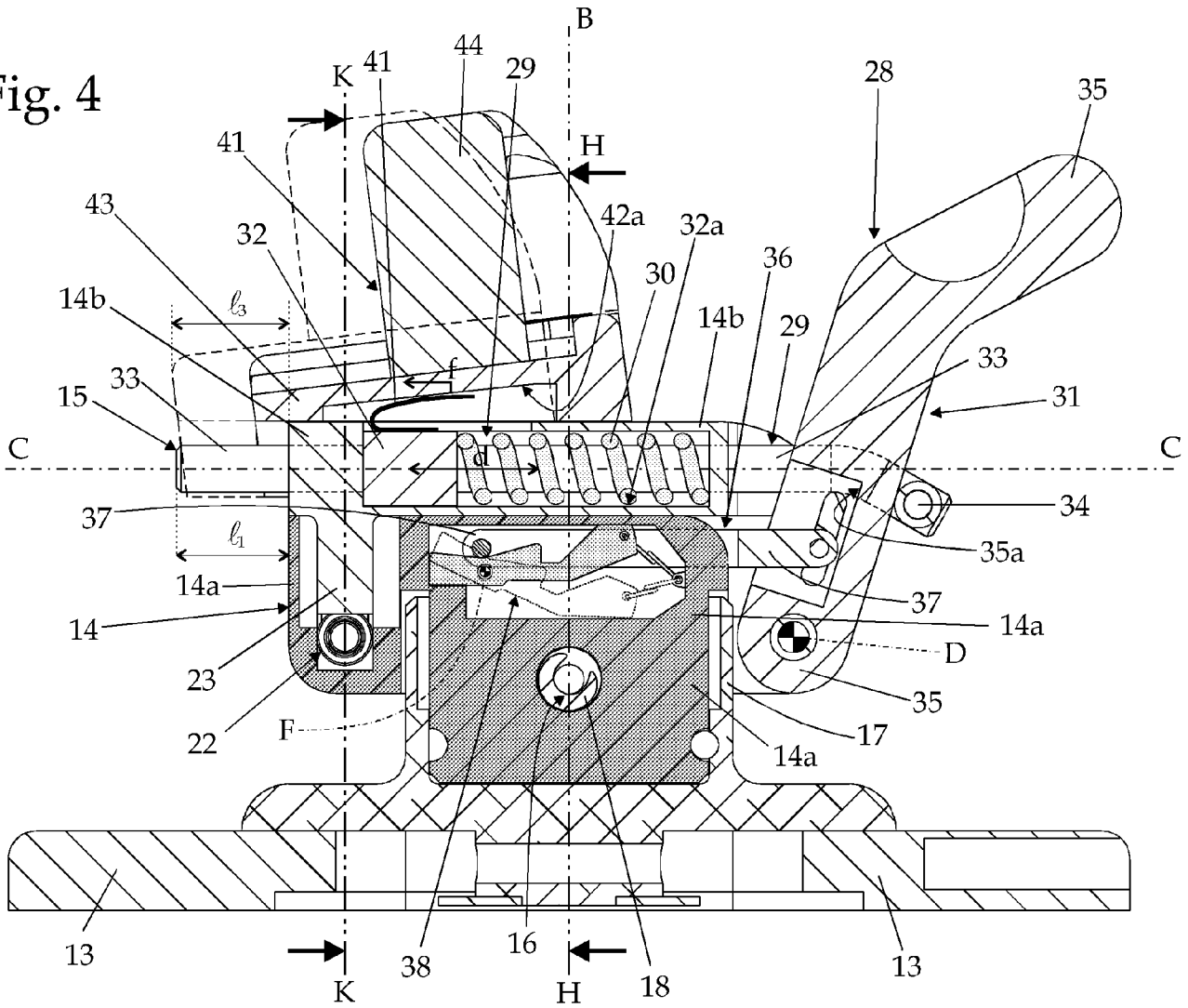
FIG. 4 is a side view of the heelpiece of the ski mountaineering binding device shown in FIG. 1, taken along the vertical middle plane.
Figure 5:
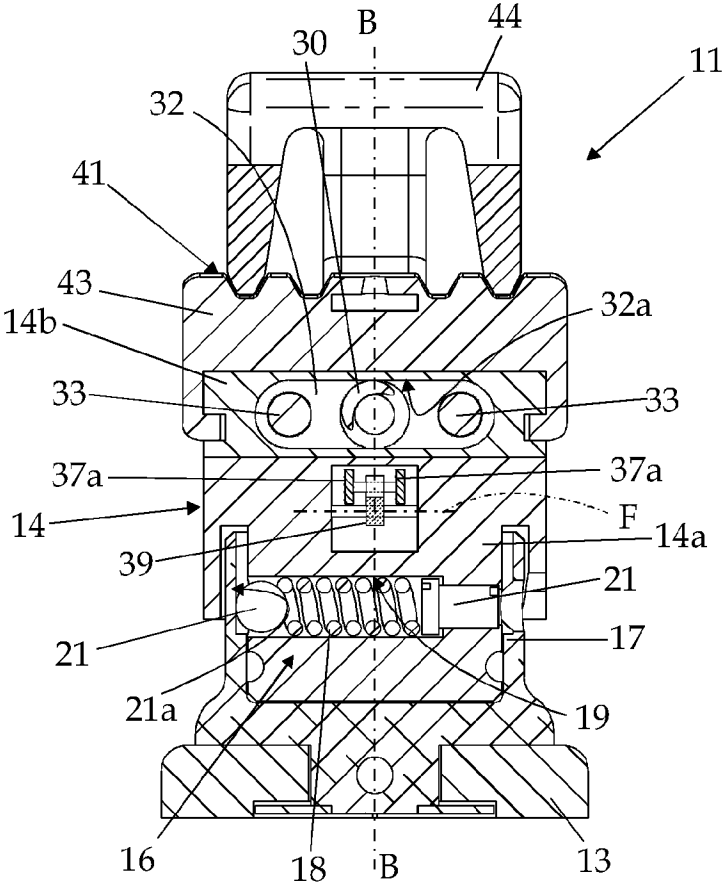
FIG. 5 is a front view of the heelpiece in FIG. 4 taken along section line H-H, and with parts removed for clarity.

With reference to FIGS. 4 and 5, in particular in the example shown, the turret 14 is preferably fixed onto the fastening plate 13 with the possibility of freely rotating about axis B, and the heelpiece 13 is preferably also provided with an elastic programmed-release locking member 16, which is structured so as to allow the rotation of turret 14 about axis B when the twisting torque exceeds a predetermined threshold value.

In other words, the elastic locking member 16 is structured so as to elastically contrast any rotation of turret 14 about axis B, which would compromise the alignment between reference axis C of the hooking appendix 15 and the longitudinal ski axis L, such an alignment allowing the projecting appendix 15 to engage the rear part of shell 4 so as to stably retain the heel 6 of the ski boot 2 in abutment on, or however close to, the back of ski 3, thus preventing any rotation of the ski boot 2 about axis A.

In the example shown, in particular, the upper turret 14 is partially inserted and locked in an axially rotational manner within a tubular cylindrical hub 16 which juts out from the upper face of the fastening plate 13, thus remaining locally coaxial to the rotation axis B of the turret 14.

Instead, with reference to FIG. 5, the elastic locking member 16 is preferably, but not necessarily accommodated in the portion of turret 14 which is rotationally inserted into the hub 17, and comprises:

- a helical spring 18 or similar elastic element, which is inserted into a through hole 19 made in a diametrical position on the portion of the turret 14 which is rotationally inserted into the hub 17;
- a locking ball or pin 20, which is inserted in an axially sliding manner at a first end/mouth of the pass-through hole 19; and finally
- a threaded dowel 21 screwed at the second end/mouth of the through hole 19.

The helical spring 18 is fitted in the through hole 19 so that one of its two ends abuts on the locking ball 20 and the other is on the threaded dowel 21, and is preloaded under compression by means of the threaded dowel 21, so as to push and strongly maintain the locking ball 20 abutting on the inner surface of the hub 17, within a stop seat or recess 20*a* appropriately obtained on the cylindrical tubular wall of hub 17.

With reference to FIGS. 2, 3, 4, 5 and 6, the turret 14 is further divided into a fixed lower casing 14*a*, which is rigidly or axially rotationally fixed directly to the fastening plate 13, and into a tiltable upper casing 14*b*, which rests on the top of the lower casing 14*a*, and is hinged to the lower casing 14*a* on the opposite side with respect to the toepiece 10, so as to freely rotate about a reference axis D, which is locally substantially perpendicular to axes B and C, i.e. locally substantially perpendicular to axes B and C, i.e. is locally substantially perpendicular to the middle plane of turret 14.

In particular, in the example shown, the lower part of the lower casing 14*a* is locked in an axially rotational manner within the tubular hub 17, so as to allow the whole turret 14 to rotate about axis B, and the elastic locking member 16 is structured so as to allow the rotation of the lower casing 14*a* about axis B when the twisting torque exceeds a predetermined threshold value.

The hooking projecting appendix 15 of the heelpiece 11 juts out from the tiltable upper casing 14*b* while remaining locally substantially parallel to axis C, and the heelpiece 11 is further provided with a programmed-release locking member 22 which is preferably, but not necessarily, accommodates in the lower casing 14*a* of the turret, and is structured so as to lock and retain the tiltable upper casing 14*b* abutting on the lower casing 14*a* with reference axis C of the hooking projecting appendix 15 arranged locally substantially parallel to the longitudinal axis L of the ski.

More in detail, the programmed-release locking member 22 is structured so as to lock and retain the tiltable upper casing 14*b* abutting on the lower casing 14*a* with reference axis C of the hooking projecting appendix 15 locally substantially parallel to the longitudinal axis L of the ski, until the tilting torque transmitted to the tiltable upper casing 14*b* exceeds a predetermined threshold value; and so as to completely release the tiltable upper casing 14*b* from the lower casing 14*a* when the tilting torque transmitted to the tiltable upper casing 14*b* exceeds the aforesaid threshold value, so as to allow the tiltable upper casing 14*b* to freely rotate backwards about the articulation axis of the hinge, i.e. about axis D.

In particular, in the example shown, the top of the lower casing 14*a* preferably, but not necessarily, has a substantially parallelepiped shape and ends at the top with a flat surface which is locally substantially perpendicular to the rotation axis B of turret 14. The tiltable upper casing 14*b* is instead substantially shaped like an inverted L and rests on the lower casing 14*a* so that the upper horizontal segment of the casing rests directly on the upper flat surface of the lower casing 14*a*, and the lower vertical segment of the casing rests on the edge of the lower casing 14*a*, from the side opposite to the toepiece 10 and to the hooking projecting appendix 15.

The hooking projecting appendix 15 juts out from the end of the upper horizontal segment of the tiltable upper casing 14*b*, while the lower end of the vertical segment of the tiltable casing 14*b* is hinged directly onto the side edge of the lower casing 14*a*, by means of a transversal through pin which extends coaxially to axis D.

Figure 6:
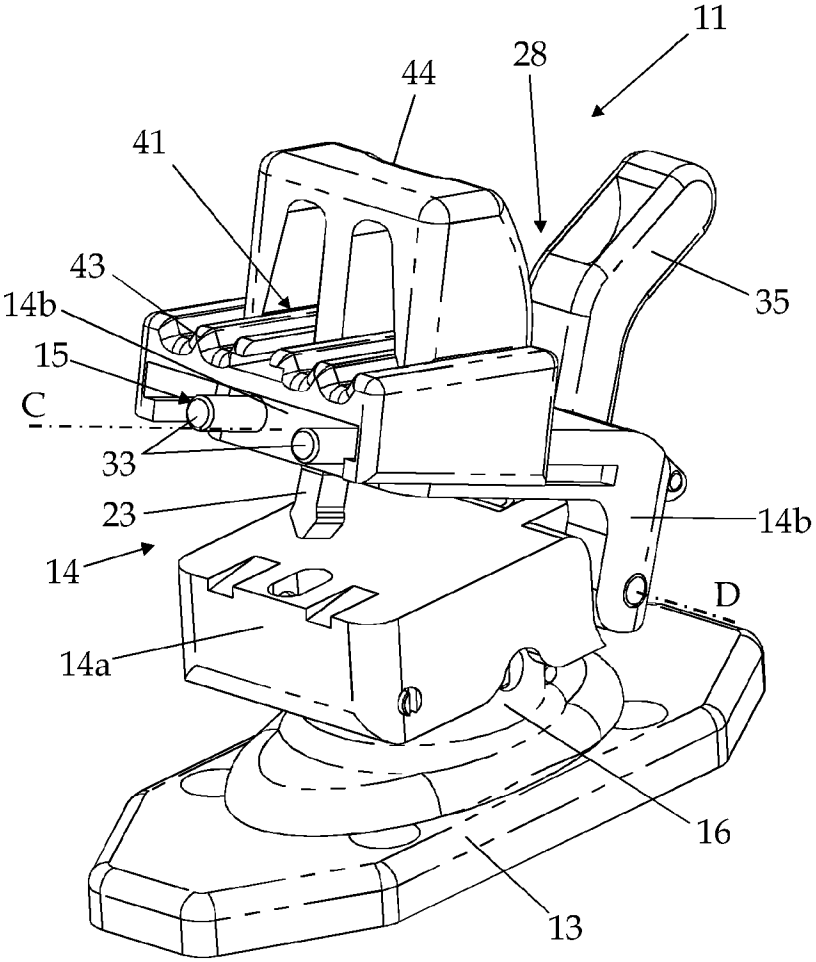
FIG. 6 is an axonometric view of the heelpiece of the ski mountaineering binding device shown in FIG. 1, in a second operating configuration.
Figure 7:
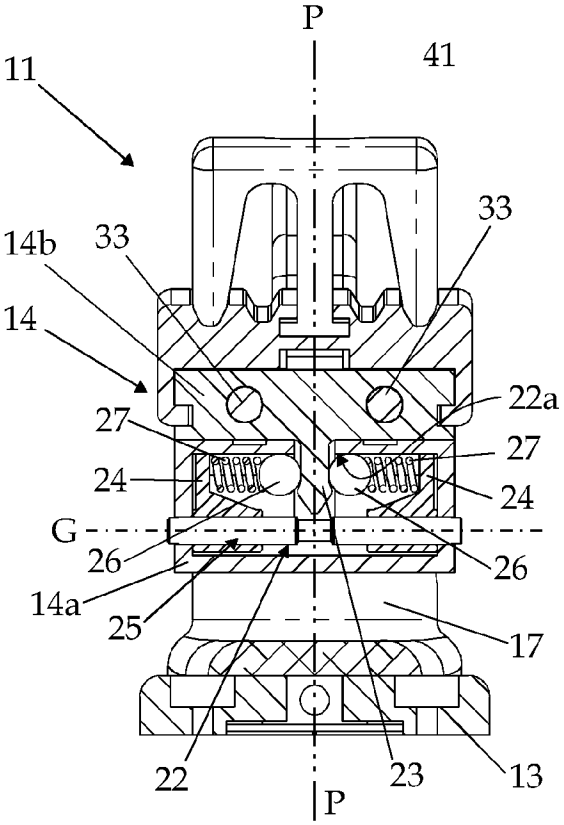
FIG. 7 is a front view of the heelpiece in FIG. 4 taken along section line K-K.

With reference to FIGS. 4, 6 and 7, the locking member 22 is preferably arranged within a cavity 22*a* specifically made in the lower casing 14*a*, close to the side edge of turret 14 from where the hooking projecting appendix 15 juts out, and is structured so as to clamp and retain until the extraction force of the tooth exceeds a predetermined threshold value, a hooking tooth 23 which juts out from the tiltable upper casing 14*b*, and penetrates into the cavity 22*a* until the locking member 22 is reached.

More in detail, in the example shown, the hooking tooth 23 juts out from the lower face of the tiltable casing 14*b*, thus remaining preferably locally substantially coplanar to the middle plane P of turret 14, and penetrates into the cavity 22*a* through a specific slot made on the top of the lower casing 14*a* to reach the locking member 22. The locking member 39 preferably comprises instead:

- two thrust bearing jaws 24, which are arranged within the cavity 22*a* which accommodates the locking member 22, on opposite sides of the middle plane P the turret where there is the hooking tooth 23;
- a manually-operated jaw adjusting mechanism 25, which is able to displace the two thrust bearing jaws 24 from and towards the middle plane of the turret, so as to adjust the distance existing between each thrust bearing jaw 41 and the middle plane P of turret 14;
- two locking balls 26, which are arranged in abutment against the side edges of the hooking tooth 23, on opposite sides thereof, so as to be aligned each to a respective thrust bearing jaw 24; and finally
- two helical springs 27 or similar elastic elements, each of which is interposed between a corresponding thrust bearing jaw 24 and the corresponding locking ball 26, so as to strongly push the locking ball 26 into abutment against the edge of the hooking tooth 23.

The preload of the helical springs 27 is adjusted by varying, by means of the adjustment mechanism 25, the distance which separates the two thrust bearing jaw 24 from the middle plane of the turret 14, where the hooking tooth 23 lays.

The hooking tooth 23 and the locking balls 26 are shaped/dimensioned so as to generate an elastic recalling force parallel to the tooth, which tends to pull the hooking tooth 23 into the lower casing 14*a*; and so as to prevent the hooking tooth 23 from being extracted our of the lower casing 14*a* until the extraction force is maintained under the predetermined limit value, which depends on the force with which the helical springs 27 squeeze the locking balls 26 against the hooking tooth 23.

With reference to FIG. 7, in particular in the example shown, the jaw adjusting mechanism 25 consists of a transversal supporting shaft 25, which extends coaxially to a reference axis G locally substantially perpendicular to the middle plane P of turret 14 (i.e. locally substantially parallel to the rotation axis D of the tiltable upper casing 14*b*) and engages tiltable lower casing 14*a* of the head 14 in a pass-through and axially rotational manner, intersecting the cavity 22*a* which accommodates the locking member 22.

The supporting shaft 42 has, on opposite sides of the middle plane P of turret 14, two threaded portions with specular thread, and the two thrust bearing jaws 24 are screwed each on a respective threaded portion of the shaft, so that the rotation of the supporting shaft 25 about axis G allows to simultaneously approach/space apart the two thrust bearing jaws 24 from the middle plane P of turret 14.

With reference to FIGS. 2, 3, 4 and 8, the hooking projecting appendix 15 of the heelpiece 11 is instead preferably fixed to the tiltable upper casing 14*b* of turret 14 with the possibility of moving with respect to the tiltable casing between:

- a completely extracted position (see FIGS. 2, 4 and 8), in which the hooking projecting appendix 15 juts out from the tiltable upper casing 14*a* of turret 14 by a predetermined length 11 sufficient to completely engage the rear part of shell 4 so as to prevent any rotation of the ski boot 2 about axis A; and
- a retracted position (see FIGS. 3 and 8), in which the hooking projecting appendix 15 is completely retracted within the tiltable upper casing 14*b*, or juts out from the body of the turret 14 by a length 12 which is shorter than length $l_1$, so as not to reach and lock the rear part of shell 4.

Additionally, the heelpiece 11 also comprises a manually-operated command device 28, which is structured so as to selectively and alternatively move and lock the hooking projecting appendix 15 either in the completely extracted position or in the retracted position.

More in detail, the command device 28 can arranged the hooking projecting appendix 15 alternatively and as desired either in the completely extracted position or in the retracted position, by moving the projecting appendix 15 with respect to the tiltable upper casing 14*b* in a direction d locally parallel to reference axis C of the protruding appendix itself.

With reference to FIGS. 4, 5 and 6, in particular in the example shown, the heelpiece 11 comprises a latch element 29 which extends through the upper horizontal segment of the tiltable upper casing 14*b* thus remaining locally substantially coaxial, or however parallel, to the reference axis C of the projecting appendix 15, with the possibility of moving forwards and backwards with respect to the tiltable upper casing 14*b* parallel to axis C.

The hooking projecting appendix 15 consists of the tip of the latch element 29, and the command device 28 is structured so as to move the latch element 29 forward and backward with respect to the tiltable upper casing 14*b* of turret 14 parallel to axis C, and then to stably lock the latch element 29 alternatively in an advanced position or in a retracted position.

More in detail, the manually-operated command device 28 is structured so as to move and lock the latch element 29 to an advanced position (see FIGS. 4 and 5), in which the tip 15 of the latch element 29 juts out from the body of the tiltable upper casing 14*b* by a predetermined length $l_1$ sufficient to completely engage the rear part of the shell 4 so as to prevent any rotation of the ski boot 2 about axis A; or to a retracted position (see FIG. 7) in which the tip 15 of the latch element 29 is either completely retracted within the body of the tiltable upper casing 14*b*, or juts out from the casing itself by a length $l_2$ which is considerably shorter than the length $l_1$, so as not to reach and lock the rear part of shell 4.

Obviously, the hooking projecting appendix 15 is in the completely extracted position when the latch element 29 is in the advanced position.

With reference to FIG. 4, in particular in the example shown, the command device 28 preferably comprises: an antagonist elastic element 30, which is interposed between the latch element 29 and the body of the tiltable upper casing 14*b*, and is structured so as to bring and elastically maintain the latch element 29 in the advanced position (see FIGS. 2, 4 and 6), which corresponds to arranging the hooking projecting appendix 15 in the completely extracted position; and a manually-operated moving member 31 which is interposed between the latch element 29 and the body of turret 14, and is structured so as to allow the user to move the latch element 29 from the advanced position to the retracted position, thus overcoming the elastic force of the antagonist elastic element 30.

Additionally, the manually-operated moving member 31 is also structured so as to selectively lock the latch element 29 in the retracted position, thus overcoming the elastic force of the antagonist elastic element 30.

With reference to FIGS. 4, 5, 7 and 8, in particular in the example shown, the latch element 29 consists of a sliding shoe or carriage 32, which is inserted in an axially sliding manner into an elongated cavity 32*a* extending into the tiltable upper casing 14*b*, thus remaining locally coaxial to the reference axis C of the projecting appendix 15; of a pair of rectilinear stems or pins 33 preferably, but not necessarily, with circular section, extending by the side and parallel to axis C, on opposite sides of the middle plane of turret 14, so as to completely cross the sliding shoe or carriage 32 and jut out from both sides of the tiltable upper casing 14*b* of turret 14; and of a crosspiece 34, which is adapted to rigidly connect together the rear distal ends of the two pins 33, i.e. the ends which are on the opposite side with respect to tip 10.

The two rectilinear pins 33 are rigidly fixed to the sliding shoe or carriage 32 so as to move parallel to axis C, along with the sliding shoe or carriage 32; while, the front distal ends of the two rectilinear pins 33, i.e. the distal ends which face the tip 10 of the ski mountaineer binding device 1, are shaped/structured so as to be engaged in the rear part of shell 4 in order to stably retain the heel 6 of the ski boot 2 in abutment on, or however close to, the back of ski 3.

In other words, the front distal ends of the two rectilinear pins 33 can axially move from and to the tip 10 in order to couple and lock the rear part of the shell 4 hinged on the gripper-like clamping member 12 of the toepiece 10, thus forming the hooking projecting appendix 15 of the heelpiece 11.

With reference to FIGS. 4, 5 and 6, the elongated cavity 32*a* which is obtained within the tiltable upper casing 14*b* of turret 14, is obviously shaped/dimensioned so as to allow the sliding shoe or carriage 32 to move within the tiltable upper casing 14*b* parallel to axis C, between an advanced position (see FIG. 4), in which the distal ends 15 of the two rectilinear pins 33 jut out from the body of turret 14 by a predetermined length $l_1$ sufficient to completely engage in the rear part of shell 4 so as to prevent any rotation of the ski boot 2 about the axis A; and a retracted position (see FIG. 8), in which the distal ends 15 of the two rectilinear pins 33 are either completely retracted within the body of turret 14, or jut out from the body of turret 14 by a length $l_2$ which is much shorter than the length $l_1$, so as not to reach the rear part of shell 4.

Figure 8:
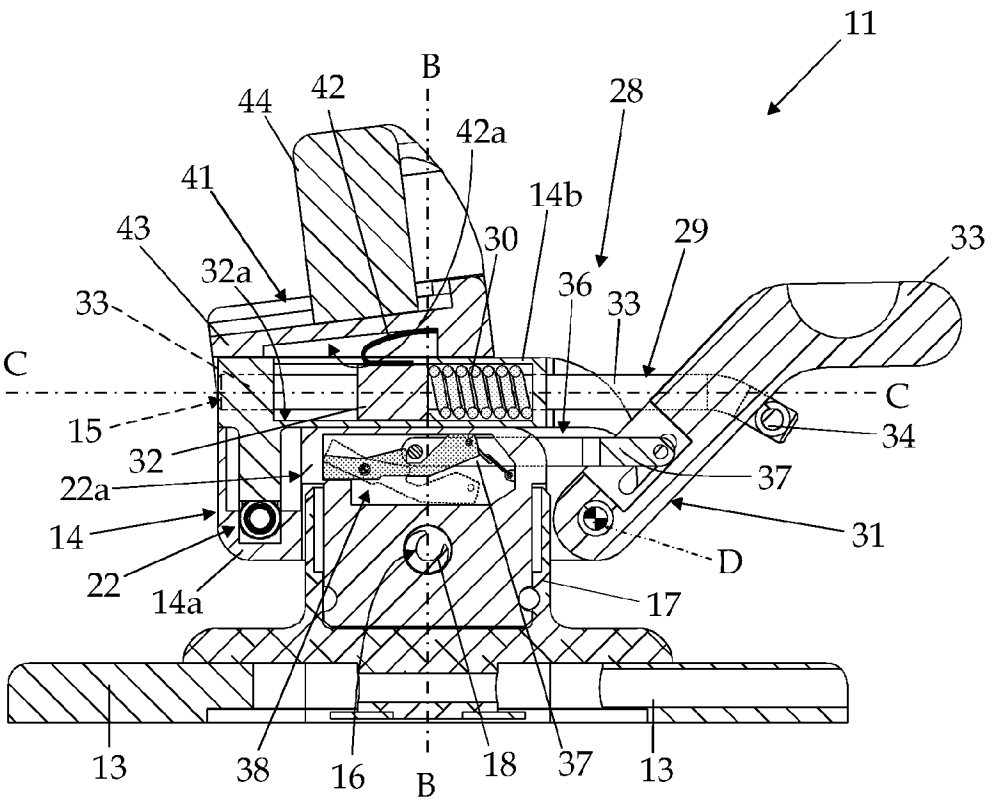

Again with reference FIGS. 4, 5 and 8, the antagonist elastic element 30 instead preferably, but not necessarily, consists of a helical spring 30 or similar elastic member, extending into the elongated cavity 32*a* locally substantially coaxial to axis C, so as to be arranged between the two rectilinear pins 33, and one of its two axial ends is stably in abutment on a body of the sliding shoe 26 and the other is on the body of the tiltable upper casing 14*b*. The helical spring 30 is additionally preloaded under compression so as to strongly push and maintain the sliding shoe or carriage 32 in abutment on the end of the elongated cavity 32*a* facing the toepiece 10, so as to make the distal ends 15 of the two rectilinear pins 33 protrude and maintain them either in the advanced or in the completely retracted position.

With reference to the accompanying figures, the manually-operated moving member 31 which allows the user to move the latch element 29 forwards and backwards thus overcoming the force of the helical spring 30, comprises instead:

- a command lever 35 which is hooked onto the rear part of the latch element 29, and has its lower end hinged on the side edge of the lower casing 14*a* of turret 14, on the opposite side with respect to said hooking projecting appendix 15, so as to freely oscillate on a reference plane locally substantially parallel to, and preferably also coinciding with the middle plane P of the turret 14; and
- a locking device 36 which is interposed between the lower casing 14*a* of turret 14 and the command lever 35, capable of immobilizing/locking in a rigid and stable, although easily releasable manner the command lever 35 in an intermediate unlocking position (see FIGS. 3 and 8), in which the command lever 35 is tilted with respect to the vertical by a predetermined angle, so as to arrange and maintain the latch element 29 in the retracted position, thus overcoming the force of the helical spring 30.

In particular, in the example shown, the lower end of the command lever 35 is hinged to the side edge of the lower casing 14*a* of turret 14, on the opposite side with respect to the hooking projecting appendix 15, so as to rotate about a transversal reference axis, which is locally substantially horizontal to axes B and C, and further preferably, but not necessarily, even coinciding with the rotation axis D of the tiltable upper casing 14*b* of turret 14.

The locking device 36 is instead structured so as to allow the command lever 35 to oscillate about the transversal axis D to be alternatively arranged in a locking position (see FIGS. 2 and 4) in which the command lever 35 is arranged in a substantially vertical position, so as to allow the antagonist elastic element 30 to arrange the latch element 29 in the advanced position; in an unlocking position (see FIGS. 3 and 8) in which the command lever 35 is tilted by a predetermined angle with respect to the vertical, so as to arrange and maintain the latch element 29 in the retracted position, thus overcoming the force of the helical spring 30; and finally in a switching position, in which the command lever 35 is tilted by a predetermined angle with respect to the vertical, which is larger than that taken in the unlocking position.

The locking device 36 is further structured so as to allow the command lever 35 to move/pass from the unlocking position to the locking position, exclusively after the command lever 35 has been temporarily positioned in the switching position.

In particular, in the example shown, the command lever 35 engages in a pass-through manner the recess delimited by the two rectilinear pins 33 and by the stiffening crosspiece 34 of the latch element 29, so as to rest and freely slide on the stiffening crosspiece 34 of the latch element 29.

When the tiltable upper casing 14*b* tilts backwards while rotating about axis D, the crosspiece 34 of the latch element 29 moves away from the command lever 36, whereby the manually-operated moving member 31 does not obstruct/prevent the free tilting movement of the tiltable upper casing 14*b*.

With reference to FIG. 4, the locking device 36 comprises instead a rigid longitudinal stem or strut 37, which has a first end hinged in a freely rotational and sliding manner within a transversal guide slot 35*a* made on the body of the command lever 35, and a second end inserted in an axially sliding manner into the lower casing 14*a* of turret 14, immediately underneath the tiltable upper casing 14*b* and the latch element 29; and a flip-flop snap locking mechanism 38 which is accommodated within the lower casing 14*a*, immediately under the tiltable upper casing 14*b* and the latch element 29, and is structured so as to selectively prevent the second end of the longitudinal strut 37 from penetrating into the lower casing 14*a* beyond a predetermined limit which corresponds to arranging the command lever 33 in the above-mentioned unlocking position.

More in detail, the snap locking mechanism 38 is structured so as to allow the longitudinal strut 37 to slide into the lower casing 14*a* between an advanced position, which corresponds to the command lever 35 arranged in the locking position, and a retracted position, which corresponds to the command lever 35 arranged in the switching position. Additionally, the snap locking mechanism 38 is structured so as to selectively stop/lock the stroke of the strut 37 towards the advanced position, when the strut 37 is in an intermediate position between an advanced position and a retracted position.

The command lever 35 is in the unlocking position when the strut 37 is in the intermediate position and the snap locking mechanism 38 is finally structured so as to be arranged in/switch to the configuration which leaves strut 37 free to complete the stroke towards the advanced position, when the longitudinal strut 37 is temporarily taken to the retracted position.

With reference to FIGS. 4, 5, 8 and 9, in particular in the example shown, the portion of strut 37, which is slidingly inserted into the lower casing 14*a* of turret 14, extends along a reference axis E which is locally substantially coplanar and preferably also substantially parallel to axis C of the latch element 29.

Furthermore, the longitudinal strut 37 preferably, but not necessarily, consists of a fork element 37 which has a central trunk hinged directly onto the command lever 35 by means of a transversal pin which may freely slide within the guide slot 35*a* made on the body of the command lever 35, and has the two arms or tines 37*a* which extend in an axially sliding manner into turret 14, where the snap locking mechanism 38 is accommodated.

With particular reference to FIG. 8, the snap locking mechanism 38 preferably comprises instead a pivoting rocker arm 39 which is fixed within the lower casing 14*a* of turret 14, next to the second end of the rigid strut 37, with the possibility of freely oscillating while remaining on a laying plane locally and substantially coplanar or however parallel to the longitudinal axis E of the strut 37; and an elastic member 40, here a scissor-like spring, which is interposed between the pivoting rocker arm 39 and the lower casing 14*a* of turret 14, and is structured so as to elastically maintain the rigid strut 37, either selectively or alternatively, in two different operating positions.

In the first operating position, the pivoting rocker arm 39 is close to the longitudinal strut 37, and can hook the strut 37 thus preventing it from completing the movement from the intermediate position to the advanced position, i.e. from further penetrating into the body of the lower casing 14*a* of turret 14. In the second operating position, the pivoting rocker arm 39 is instead away from the longitudinal strut 37, and allows the longitudinal strut 37 to freely move with respect to the lower casing 14*a* of turret 14, parallel to axis E and towards the advanced position.

In the example shown, the pivoting rocker arm 39 is preferably hinged onto the lower casing 14*a* so as to freely oscillate about a transversal rotation axis F which is locally substantially orthogonal to reference axis E of the rigid strut 37, while remaining on a laying plane locally substantially coplanar or however parallel to axes B and E, and preferably also substantially coinciding with the middle plane P of turret 14.

The pivoting rocker arm 39 is structured/shaped so as to automatically cause the movement of the rocker arm from the second to the first operating position, when the longitudinal strut 37 reaches the advanced position under the force of the elastic element 24; and so as to automatically cause the movement of the rocker arm from the first to the second operating position, when the longitudinal strut 37 reaches the retracted position being pulled by the command lever 35.

Figure 9:
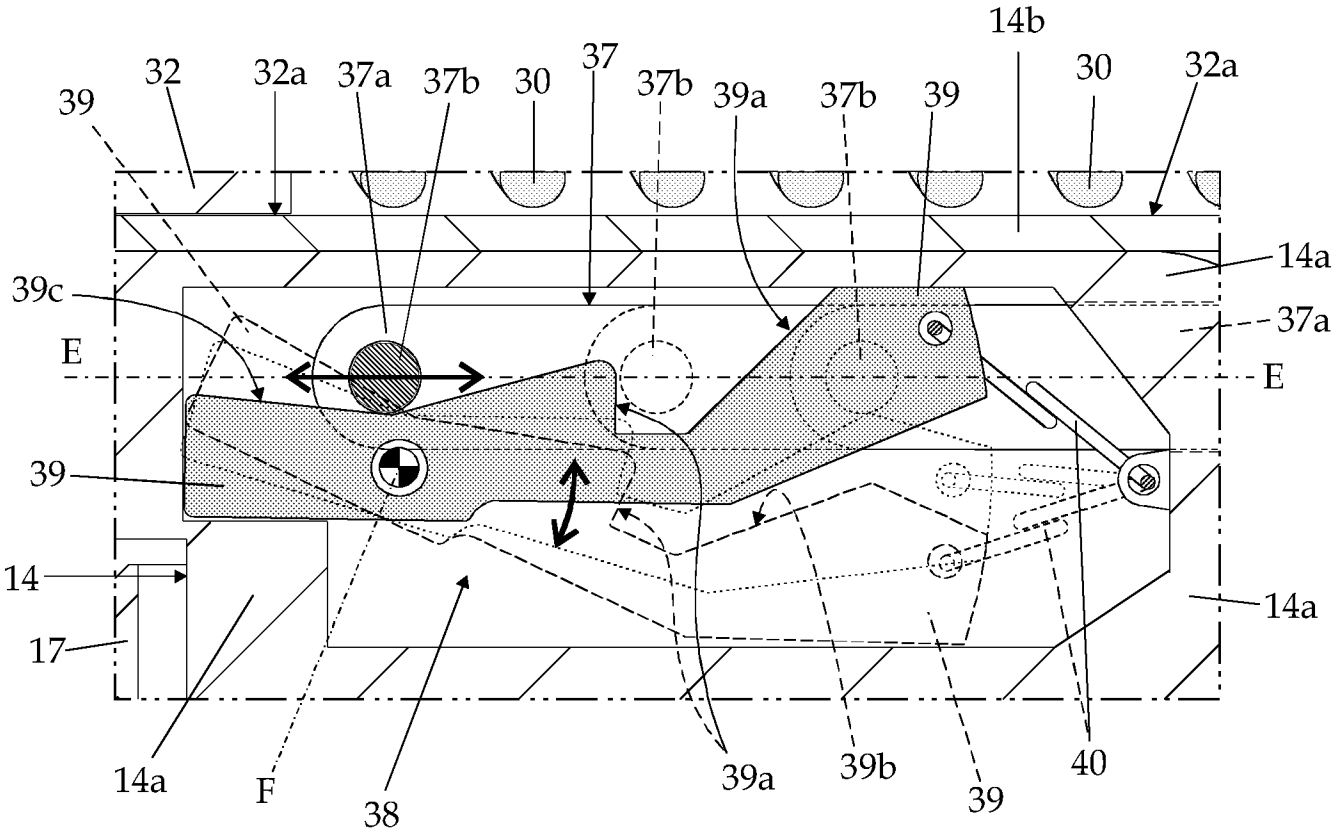
FIG. 9 shows a detail of the heelpiece in FIG. 4 on enlarged scale and with parts removed for clarity.

More in detail and with particular reference to FIGS. 5 and 9, in the example shown, the pivoting rocker arm 39 is preferably placed between the two arms or tines 37*a* of the strut 37, and is provided with a detent 39*a* which projects towards the strut 37 immediately above, at a predetermined distance from the rotation axis F, and is dimensioned so as to hook a transversal pin 37*b* which rigidly connects together the arms or tines 37*a* of the strut 37, when the pivoting rocker arm 39 is in the first operating position.

At a greater distance from the rotation axis F with respect to the detent 39*a*, the pivoting rocker arm 39 further has a first switching crest 39*b* with a cam profile which extends towards the strut 37 so as to intersect the trajectory of the transversal pin 37*b* of strut 37 when the rigid strut 37 moves from the intermediate position to the retracted position.

The switching crest 39*b* is shaped so as to oblige the pivoting rocker arm 39 to rotate about axis F against the force of the elastic element 40, to pass beyond the unstable balance point which forces/obliges the elastic element 40 to move the pivoting rocker arm 39 to the second operating position.

On the opposite side with respect to the detent 39*a* and the switching crest 39*b*, the pivoting rocker arm 39 finally has a second switching crest 39*c* with a cam profile which extends towards the strut 37 so as to intersect the trajectory of the transversal pin 37*b* of strut 37 when the rigid strut 37 reaches the advanced position.

The switching crest 39*c* is shaped so as to oblige the pivoting rocker arm 39 to rotate about axis F against the force of the elastic element 40, to pass beyond the unstable balance point which forces/obliges the elastic element 40 to move the pivoting rocker arm 39 back to the first operating position.

With reference to the appended claims, the heelpiece 11 is finally provided with a heel rising member 41 which is fixed on the top of the tiltable upper casing 14*b* of turret 14 with the possibly of moving on the upper casing to and from a working position, in which the heel rising member 41 juts beyond the side edge of the turret 14 to directly support the heel 6 of the ski boot 2 in a raised position; and with a mechanical member 42, which connects the heel rising member 41 to the latch element 29 underneath and is structured so as to transmit the translation motion to the heel rising member 41, so as to move the heel rising member 41 on the top of the tiltable upper casing 14*b* substantially along with the latch element 29.

More in detail, the heel rising member 41 is fixed onto the top of the tiltable upper casing 14*b* with the possibility of sliding forwards and backwards on the turret 14 in a direction d locally substantially parallel to the reference axis C of the hooking projecting appendix 15, between a retracted or resting position (see FIG. 8), in which the heel rising member 41 is substantially aligned over turret 14, and is further preferably confined within the perimeter of the tiltable upper casing 14*b* of turret 14; and an advanced or working position (see FIGS. 4 and 6), in which the heel rising member 41 juts out beyond the side edge of the tiltable upper casing 14*b*, immediately over the hooking projecting appendix 15, so as to substantially cover as a roof the entire hooking projecting appendix 15 arranged in the completely extracted position, thus stably supporting/maintaining the heel 6 of the ski boot 2 in a raised/lifted position with respect to the back of ski 2.

In other words, when the heel rising member 41 is in the advanced or working position (see dashed line in FIG. 4), it juts out beyond the side of the turret 14 by a length $l_3$ such as to exceed/pass beyond the distal ends 15 of the two rectilinear pins 33 which, in turn, jut out from the body of the tiltable upper casing 14*b* by a length $l_1$ sufficient to completely engage the rear part of the shell 4 hinged onto the toepiece 10.

The mechanical member 42 is instead structured so as to move the heel rising member 41 to the retracted or resting position when the latch element 29 moves to the retracted position to arrange the distal ends 15 of the two rectilinear pins 33, i.e. the hooking projecting appendix 15, in the retracted position; and to move the heel rising member 41 to the advanced or working position when the latch element 29 moves to the advanced position to arrange the distal ends 15 of the two rectilinear pins 33 in the completely retracted position.

More in detail, in the example shown, the mechanical member 42 is preferably structured so as to rigidly restrain the heel rising member 41 to the latch element 29, when the latch element 29 moves from the advanced position to the retracted position; and to elastically restrain the heel rising member 41 to the latch element 29, when the latch element 29 moves from the retracted position to the advanced position.

With particular reference to FIGS. 2, 3 and 4, in particular in the example shown, the heel rising member 41 comprises a main supporting plate 43, which rests on the top of turret 14, and is slidingly fixed to the body of turret 14 so as to slide forwards and backwards on the top of turret 14 in a direction $d_a$ locally substantially parallel to the reference axis C of the hooking projecting appendix 15; and preferably also an auxiliary supporting block 44, which rests on the upper face of the main supporting plate 43, and is slidingly fixed onto the body of the supporting plate 43, so as to slide forwards and backwards on the top of the supporting plate 43 in a direction $d_b$ preferably locally substantially parallel to the reference axis C of the hooking projecting appendix 15.

Both the supporting plate 43 and the auxiliary supporting block 44 are structured to support the heel 6 of ski boot 2.

The mechanical member 42, instead, is structured so as to connect the main supporting plate 43 of the heel rising member 41 to the latch element 29 immediately underneath, so as to move the supporting plate 43 between a retracted or resting position (see FIG. 8) in which the supporting plate 43 is substantially confined within the perimeter of the top of the tiltable upper casing 14*b* of turret 14; and an advanced or working position (see dashed line in FIG. 4) in which the main supporting plate 43 juts out beyond the side edge of the tiltable upper casing 14*b*, immediately over the hooking projecting appendix 15, so as to substantially cover as a roof the whole hooking projecting appendix 15 arranged in the completely extracted position.

In particular, in the example shown, the mechanical member 42 comprises a flexible tongue 42 made of an elastically deformable material, which is substantially C-folded, and is rigidly fixed on the sliding shoe or carriage 32 of the latch element 29, so as to jut out from the top of the tiltable upper casing 14*b* of turret 14 through a longitudinal through slot which extends parallel to the reference axis C of the latch element 29. The upper side of the flexible tongue 42 is adapted to rest and slide on the body of the main supporting plate 43 of the heel rising member 41, on a bottom of a longitudinal groove 42*a* which extends on the lower face of the supporting plate 43 parallel to the reference axis C.

The bottom of the longitudinal groove 42*a* is further inclined by a few degrees towards the tip 15 of the latch element 29, i.e. towards the distal ends 15 of the rectilinear pins 33, so as to transform the upward elastic force exerted by the flexible tongue 42, into a horizontal elastic force f which tends to push the supporting plate 43 to the advanced or working position (see FIG. 4) with an increasing intensity as a function of the misalignment between the position of the supporting plate 43 and that of the sliding shoe or carriage 32 of the latch element 29.

The operation of the ski mountaineering binding device 1 can be easily inferred from the above description and no further explanations are thus required, except to explain that by moving the latch element 29 forwards and backwards, i.e. hooking projecting appendix 15 of the heelpiece 11, the rear part of shell 4 can be rapidly hooked to/unlocked from the heelpiece 11 without needing to unlock the front part of shell 4 from the toepiece 10.

There are many advantages deriving from the particular structure of the heelpiece 11. By virtue of the two-part structure of turret 14, indeed, the automatic unlocking of the rear part of shell 4 occurs in a timely manner also when, in case of falls, the vertical vector component of the pulse-like mechanical stresses has a relatively small value, i.e. when the pulse-like mechanical stresses are directed so as to be nearly tangent to the back of the ski.

Obviously, this increased sensitivity to tangential mechanical stress significantly increases the overall safety of the ski mountaineering binding device 1 as compared to those currently known.

Furthermore, the intervention threshold of the locking member 22 may be very easily and rapidly adjusted by operating directly on the preload adjustment mechanism 25 of the helical springs 27.

It is finally apparent that changes and variants can be made to the above-described ski mountaineering binding device 1 without departing from the scope of protection of the present invention.

For example, the latch element 29 may be provided with a single pin with juts out from the body of the tiltable upper casing 15*b* of turret 14, being coaxial to axis C, and has a distal end shaped so as to engage the rear part of shell 4 roughly at the heel.

Therefore, in this variant, the hooking projecting appendix 15 of the heelpiece 11 consists of this joined projecting pin.

The invention claimed is:

1. A ski binding device for fastening a mountaineering boot on a downhill ski comprising:

a toepiece and a heelpiece which are adapted to be rigidly fixed on the back of a ski, aligned along a ski longitudinal axis (L), and are structured so as to selectively retain respectively a front part and a rear part of a shell of a boot;

the toepiece being provided with a clamping member which is structured for selectively clamping and stably retaining the front part of the shell, and at the same time allowing the shell to pivot freely on the toepiece about a boot rotation axis (A) which is substantially perpendicular to the ski longitudinal axis (L);

the heelpiece comprising a fastening base structured for being rigidly fastened on the back of the ski; a turret which protrudes upwards from the fastening base; and a hooking projecting appendix that juts out from the turret towards the toepiece while remaining substantially parallel to a first reference axis (C) substantially aligned to the ski longitudinal axis (L), and is structured so as to couple to the rear part of the shell to stably retain the heel of the boot in abutment on or close to the back of the ski, therefore preventing any rotation of the boot on the toepiece about said boot rotation axis (A);

the ski binding device being characterized in that the turret of the heelpiece is subdivided in a lower casing which is fixed on the fastening base, and in a tiltable upper casing that rests on the top of the lower casing, and is hinged on the lower casing so as to freely rotate about a second reference axis (D) substantially perpendicular to said first reference axis (C); the hooking projecting appendix of the heelpiece protruding from the tiltable upper casing while remaining substantially parallel to said first reference axis (C), and the heelpiece being also provided with programmed-release locking means which are structured so as to lock and retain the tiltable upper casing in abutment on the lower casing of the turret with the first reference axis (C) arranged substantially parallel to the ski longitudinal axis (L), until the tilting torque transmitted to the tiltable upper casing exceeds a predetermined threshold value.

2. The ski binding device according to claim 1, wherein the tiltable upper casing is hinged on the lower casing on the opposite side with respect to the toepiece.

3. The ski binding device according to claim 2, wherein the tiltable upper casing is substantially inverted L-shaped and rests on the lower casing so that the upper horizontal segment of the tiltable upper casing leans directly on the top of the lower casing, and in that the lower vertical segment of the tiltable lower casing leans on the side of the lower casing, on the opposite side with respect to the toepiece; the hooking projecting appendix protruding from the end of the upper horizontal segment of the tiltable upper casing; the lower end of the vertical segment of the tiltable upper casing instead being hinged on the side of the lower casing.

4. The ski binding device according to claim 1, wherein said programmed-release locking means are located within a cavity specifically realized in the lower casing, close to the side of the turret from which the hooking projecting appendix protrudes, and are structured so as to clamp and retain a hooking tooth which protrudes from the tiltable upper casing and penetrates within the lower casing up to reach said programmed-release locking means, until the extraction force of the tooth exceeds a predetermined threshold value.

5. The ski binding device according to claim 4, wherein said programmed-release locking means comprise:

two thrust bearing jaws which are arranged within the cavity that houses the locking member, on opposite sides of the lying plane (P) of the hooking tooth;

a manually-operated jaw adjusting mechanism which is able to displace the two thrust bearing jaws from and towards the lying plane (P) of the hooking tooth, so as to adjust the distance existing between each thrust bearing jaw and the lying plane (P) of the hooking tooth;

two locking balls which are arranged in abutment against the sides of the hooking tooth, on opposite sides of the hooking tooth, so as to be aligned each to a respective thrust bearing jaw; and finally two elastic elements each of which is interposed between a corresponding thrust bearing jaw and the relative locking ball, so as to strongly push the locking ball in abutment against the side of the hooking tooth.

6. The ski binding device according to claim 5, wherein the jaw adjusting mechanism comprises a transversal supporting shaft which extends coaxially to a third reference axis (G) substantially perpendicular to the lying plane (P) of the hooking tooth, and engages in pass-through and axially rotatable manner the tiltable lower casing of the turret, intersecting the cavity that houses the locking member; said supporting shaft being provided, on opposite sides of the lying plane (P) of the hooking tooth, with two threaded portions with specular thread, and the two thrust bearing jaws being screwed each on a respective threaded portions of the shaft.

7. The ski binding device according to claim 1, wherein the hooking projecting appendix of the heelpiece is fixed on the tiltable upper casing of the turret with the possibility of moving with respect to the tiltable upper casing between a completely extracted position in which the hooking projecting appendix protrudes from the tiltable upper casing by a first predetermined length ($l_1$) sufficient to completely engage the rear part of the shell of the boot so as to avoid any rotation of the boot about said boot rotation axis (A); and a retracted position in which the hooking projecting appendix is retracted within the tiltable upper casing or protrudes from the body of the turret by a second length ($l_2$) having a value such as to prevent the hooking projecting appendix to reach and lock the rear part of the shell of the boot;

the heelpiece also comprising a manually-operated command device, which is structured so as to move and lock the hooking projecting appendix selectively and alternatively in the completely extracted position and in the retracted position.

8. The ski binding device according to claim 7, wherein the heelpiece comprises a latch element which extends in pass-through manner through the upper horizontal segment of the tiltable upper casing of the turret while remaining substantially parallel to said first reference axis (C), with the possibility of moving forwards and backwards with respect to the tiltable upper casing parallelly to the same axis (C); the hooking projecting appendix being formed by the tip of said latch element, and the manually-operated command device being structured so as to move the latch element forwards and backwards with respect to the tiltable upper casing, and then stably lock the latch element alternatively in an advanced position in which the tip of the latch element protrudes from the tiltable upper casing by a first predetermined length ($l_1$) sufficient to completely engage the rear part of the shell so as to prevent any rotation of the boot about said boot rotation axis (A); and in a retracted position in which the tip of the latch element is refracted within the tiltable upper casing or protrudes from the tiltable upper casing by a second length ($l_2$) having a value such as to prevent the hooking projecting appendix to reach and lock the rear part of the shell of the boot.

9. The ski binding device according to claim 8, wherein the manually-operated command device comprises an antagonist elastic element which is interposed between the latch element and the body of the tiltable upper casing, and is structured so as to bring and elastically maintain the latch element in the advanced position; and a manually-operated moving member which is interposed between the latch element and the body of the turret, and is structured so as to allow the user to move the latch element from the advanced position to the retracted position, overcoming the elastic force of the antagonist elastic element.

10. The ski binding device according to claim 9, wherein the manually-operated moving member is also structured so as to selectively lock the latch element in the retracted position, overcoming the elastic force of the antagonist elastic element.

11. The ski binding device according to claim 10, wherein the manually-operated moving member comprises:

a command lever which is hooked to the rear part of the latch element, and has the lower end hinged on the side of the lower casing, on the opposite side with respect to said hooking projecting appendix, so as to freely oscillate on a reference plane substantially parallel to the central plane (P) of the turret;

a locking device which is interposed between the lower casing and the command lever, and is able to lock in a rigid and stable, although easily releasable manner, said command lever in an intermediate unlocked position in which the command lever latch element in the retracted position.

12. The ski binding device according to claim 11, wherein the locking device is structured so as to allow the command lever to oscillate about a rotation axis (D) substantially perpendicular to said first reference axis (C) for being arranged alternatively in a locked position in which the command lever is arranged substantially vertically, so as to allow the antagonist elastic element to arrange the latch element in the advanced position;

in an unlocking position in which the command lever is inclined with respect to the vertical by a predetermined angle, so as to arrange and maintain the latch element in the retracted position overcoming the force of the antagonist elastic element; and finally in a switching position in which the command lever is inclined with respect to the vertical by a predetermined angle broader than that taken in the unlocking position;

the locking device being also structured so as to allow the command lever to move/pass from the unlocking position to the locking position, exclusively after the command lever has been temporarily arranged in said switching position.

13. The ski binding device according to claim 1, wherein the lower casing of the turret is fixed to the fastening base with the possibility of freely rotating about a fourth reference axis (B) substantially perpendicular to the ski longitudinal axis (L), and in that the heelpiece is also provided with an elastic locking member which is structured so as to allow rotation of the lower casing about said fourth reference axis (B) when the torque exceeds a predetermined threshold value.

* * * * *

UNITED STATES PATENT AND TRADEMARK OFFICE

CERTIFICATE OF CORRECTION

PATENT NO. : 9,022,410 B2
APPLICATION NO. : 14/117112
DATED : May 5, 2015
INVENTOR(S) : Robert Giordani It is certified that error appears in the above-identified patent and that said Letters Patent is hereby corrected as shown below:

On the title page

In Item (57) abstract, line 8 reads:

"of the toepiece and a titlable upper casing"

It should read:

-- of the toepiece and a tiltable upper casing --

In Item (57) abstract, line 10 reads:

"from the titlable upper casing"

It should read:

-- from the tiltable upper casing --

In Item (57) abstract, line 13 reads:

"retain the upper casing until the titling"

It should read:

-- retain the upper casing until the tilting --

In the claims

In Claim 8, Line 67, it reads:

"is refracted within the tiltable"

It should read:

-- is retracted within the tiltable --

Signed and Sealed this
Sixth Day of October, 2015

Michelle K. Lee

Michelle K. Lee
*Director of the United States Patent and Trademark Office*